United States Patent [19]

Schenkel

[11] 4,023,342

[45] May 17, 1977

[54] RING SPINNING OR TWISTING PROCESS

[76] Inventor: Erwin Schenkel, Weinbergstrasse 19, 7412 Eningen, Germany

[22] Filed: May 16, 1975

[21] Appl. No.: 578,218

[52] U.S. Cl. ..... 57/156; 57/75; 57/124

[51] Int. Cl.[2] ..... D01H 1/20; D01H 7/56

[58] Field of Search ..... 57/34 R, 93, 75, 119, 57/81, 120, 156, 101, 122, 124; 356/23, 25

[56] References Cited

UNITED STATES PATENTS

| | | | |
|---|---|---|---|
| 1,717,642 | 6/1929 | Wentworth | 356/23 X |
| 3,324,643 | 6/1967 | Kluttz | 57/124 |
| 3,494,120 | 2/1970 | Chilpan et al. | 57/75 |
| 3,543,503 | 12/1970 | Watabe et al. | 57/75 |
| 3,785,140 | 1/1974 | Muller | 57/124 X |
| 3,851,448 | 12/1974 | Sano et al. | 57/124 X |

*Primary Examiner*—John Petrakes
*Attorney, Agent, or Firm*—Edwin E. Greigg

[57] ABSTRACT

A process and associated apparatus for controlling the rotational speed of a spinning or twisting ring in a spinning or twisting machine during four phases of operation. The first and second phases of operation correspond in time to the period during which the spindle of the machine associated with the ring goes from rest to a predetermined operating speed. The third and fourth phases of operation correspond in time to the period during which the spindle is returned from its operating speed back to its rest position. While the spindle is driven to its predetermined operating speed, the traveler rotates relative to the ring during the first phase of operation causing the ring to accelerate and rotate in synchronism with the traveler during the second phase of operation. During this second phase both the traveler and ring accelerate. Then while the spindle is driven back to its rest position the traveler and ring continue to rotate in synchronism during the third phase of operation, with the ring being decelerated such that the tension in the thread is retained at an adequate level to prevent rupture thereof. Finally during the fourth phase of operation the traveler rotates relative to the ring with the ring decelerating faster than the traveler.

27 Claims, 5 Drawing Figures

FIG.4
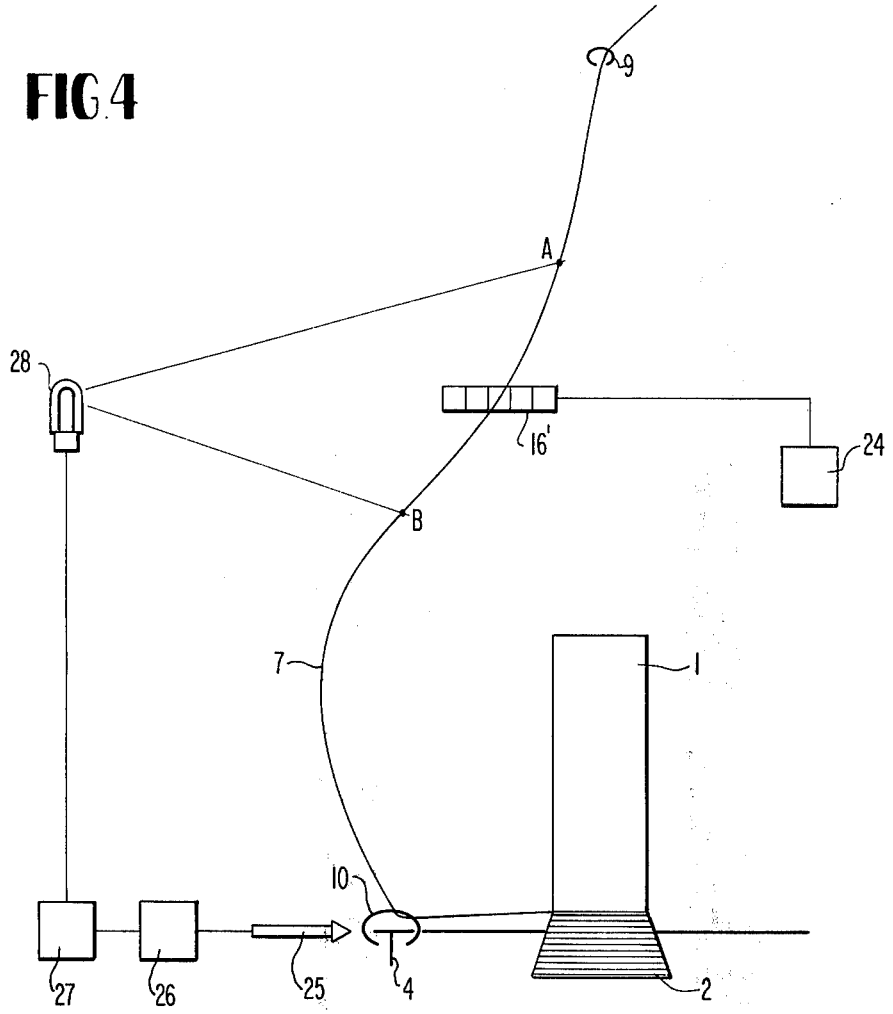
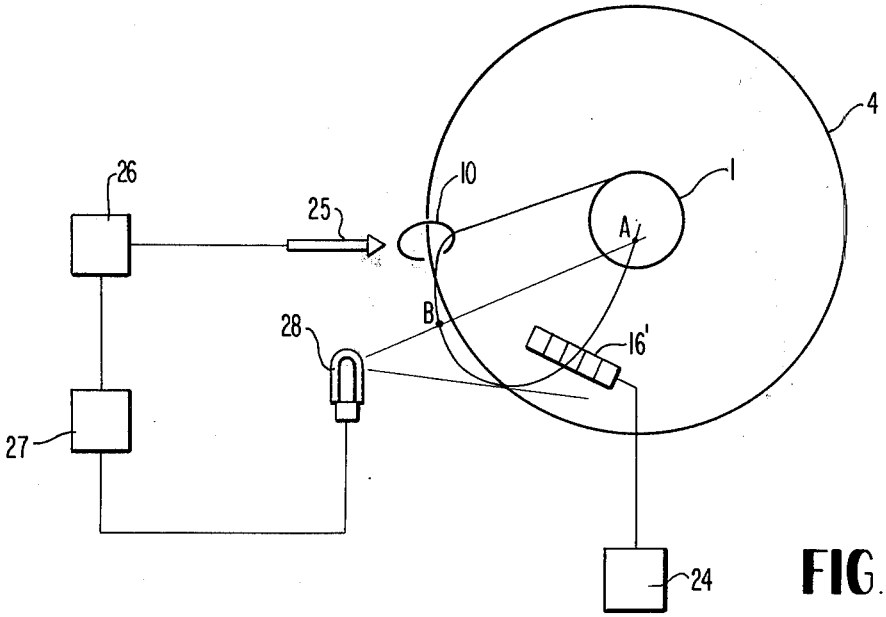
FIG.5

RING SPINNING OR TWISTING PROCESS

BACKGROUND OF THE INVENTION

The present invention relates to a process for increasing the speed of a rotatably mounted spinning or twisting ring from its rest state and for subsequently returning it to its rest state and to an apparatus for effecting this process. The apparatus forms part of a spinnning or twisting machine. The machine basically includes in addition to the ring, a traveler mounted on the ring, a driven spindle and a sleeve disposed thereon, Thread is wound on the sleeve as a result of its being drawn by the traveler, which, in turn, drives the ring.

Spinning or twisting rings of this type are disposed, as mentioned above, on spinning or twisting machines. Examples of such machines are ring spinning machines, ring twisting machines, draw-twisting machines, and the like. A machine of this type generally has a large number of these rings mounted on ring rails. The ring rails in turn are generally disposed on each longitudinal side of the machine. Each ring rail extends essentially over the entire length of the machine on its respective longitudinal side.

It has been the general practice in the art for the rings to be rigidly disposed on their respective ring rails. With this arrangement the traveler can obtain certain given speeds, which however, are too low for today's requirements. Thus for some time consideration has been given to mounting these rings in a rotatable manner, thereby enabling substantially higher traveler speeds and accordingly higher spindle speeds. As a result, the production capacity of the machine in question can be correspondingly increased.

It is undoubtedly possible in many cases to mount the rings in a rotatable manner by means of roller bearings but it is far better to use bearings which are virtually frictionless or at least frictionless at relatively low rotational speeds. It is known to provide aerostatic or aerodynamic air bearings for this purpose. Magnetic bearings which keep the ring in suspension can also be considered.

Even though the rings are rotatably mounted a problem still exists which has not yet been satisfactorily solved. This problem consists in bringing the spindles of a machine of this type from the inoperative or rest state to the operating speed (the operating speed is generally constant but it can be variable), and from the operating speed back to the rest state in order to stop spinning. This constitutes a problem because the rotatably mounted rings have a fairly considerable weight and associated relatively powerful moments of inertia which can produce extremely marked thread tension variations which cause thread breakage. Necking of the thread on the spindles especially during the terminating spinning phase, i.e., the speed at which the threads are guided to the spindles by the traveler, is greater than during the wind-on speed so that the thread balloons produced by the rotating traveler increase in size and collapse occurs. In addition, the threads twist in an uncontrolled manner about the sleeves disposed on the spindles or about the thread winding elements disposed on these sleeves. These produce thread breakage, incorrect winding onto the thread winding elements and other problems.

When yarns are spun on conventional ring spinning machines, even when air-cushioned spinning rings are used, limitations on the rotational speeds of the spindles are such as to prevent an improved spinning performance so that increased automation in the spinning process cannot be achieved.

In ring spinning there is produced between the cop on the spindle and the drawing system of the machine a thread tension which is used essentially to overcome frictional forces which are produced, especially the friction between the traveler and the ring. This system-dependent force is not uniform over the length of the thread extension. It can be measured in a known simple manner as the basic tension in the so-called spinning zone between the thread guide and the drawing system.

Under the influence of this basic tension, the centrifugal force in the thread balloon and the air friction, the thread forms between the traveler and the thread guide a spatially twisted curve which, in the projection at right angles to the axis, appears optically as the so-called "thread balloon."

The length of the thread in the balloon is greater than the distance between the traveler and the thread guide. The length increases the further the thread is deflected from the meridian plane defined by the traveler-spindle axis; in other words, the lower the thread tension under otherwise identical conditions the greater will be the length of the thread. Recognizing that the thread length can increase, it is nevertheless essential that the thread length does not fall below a minimum value as otherwise the thread curve (thread balloon) becomes unstable and results in necking and unavoidable thread breakage. In its stable phase this thread curve forms a flexible buffer zone which, if necessary, exerts a compensating action for short-term length or force variations. This occurs so long as the spatial twisting is sufficiently large so that the thread length or spatial curve generated adequately exceeds the shortest distance between the traveler and the thread guide; and so long as the actually free thread path can be achieved without having to generate excessively high force peaks for this purpose.

It is known that during spinning the above-described basic tension of the thread has constantly superimposed thereon low and high frequency periodic loading resulting from various causes. The associated load peaks increase in correspondence with the decrease in the excess thread which the balloon thread contains for flexible compensation, that is, in correspondence with the decrease in balloon height as the cop becomes increasingly full and the more the thread portion forming the balloon and disposed between the thread guide and the traveler approaches its shortest distance, or in other words becomes straight between the aforementioned spinning parts on account of increasing spinning tension and the more its deflection from the meridian plane becomes closer to zero.

It is perhaps less well know that the above-cited load peaks increase considerably as the rate of rotation of the spindle increases and that they are able to reach a multiple of the basic tension. As a result of the thread breakage which is directly associated therewith, increases in the rate of rotation and thus in the production rate are therefore restricted.

The above-described problem continues to exist in principle even when air-cushioned or magnetically mounted spinning rings are used because it is not possible to eliminate at the source of the problem the periodic load peaks caused by eccentricities of every kind in combination with the cyclical straining of the thread material as a result of periodic elongations. When air-cushioned spinning or twisting rings are used the traveler operates as a friction coupling with respect to the ring owing to centrifugal force and, for this reason, it is able, under certain conditions, to accelerate the air-cushioned spinning or twisting ring to such an extent that its rotational difference with respect to the traveler becomes zero and synchronous displacement begins. When the rotational speed and weight of the traveler are sufficiently high during synchronous displacement the sliding coupling consisting of the traveler and ring becomes a rigid, force-locking connection without any relative movement between the traveler and the ring.

As a result, the friction between the traveler and the ring is momentarily eliminated and thus, on account of the minimal air friction of the ring, the winding-on thread drawing the ring is simultaneously considerably slackened and, as a consequence, the thread tension in the balloon is suddenly reduced to the same extent. The result is a momentary broadening of the balloon diameter combined with a corresponding deflection of the balloon thread from its meridian plane which, at higher rotational speeds, generally leads to balloon collapse and thread breakage. The same result is obtained with air-cushioned spinning rings when the spinning apparatus is switched off, for example, when the cop is full and the rotational speed decreases rapidly while the ring and the traveler continue to rotate and retain their speed as a result of inertia and minimal friction. In the course thereof, the spun thread is no longer wound-on but is wound-off. As a result, the balloon expands and collapses or the thread is unhooked from the traveler. In both cases, the result is thread breakage.

OBJECTS, SUMMARY AND GENERAL DISCUSSION OF THE INVENTION

With the above in mind, it is an object of the present invention to provide a ring spinning and twisting process and apparatus which eliminates the disadvantages which prevent the rotational speed from being increased.

It is a more specific object of the present invention to provide a ring spinning and twisting process and apparatus according to which the rotational speed of the spindles is increased from the rest state to the operating state and decreased back to the rest state in such a way that the above-noted problems and disadvantages do not arise.

These and other objects are achieved by the present invention in that when air-cushioned or magnetically mounted spinning or twisting rings are used the rotational speed and thread tension are controlled in such a way that the above-described disadvantages are not effective and thus the advantage of the air-cushioned rings can be fully utilized. To this end, the initial step consists in rapidly achieving synchronous displacement of the traveler and the ring at a relatively low initial rotational speed as compared to the proposed operating speed and with the traveler having a corresponding weight. The thread tension and the centrifugal force of the traveler are still moderate owing to the low rotational speed.

This makes it easier to raise the rotational speed to the desired operating rate in a second step and, more importantly, to do this during synchronous displacement of the traveler and ring to maintain this synchronous displacement, preferably until the apparatus is switched off when the cop is full. The spinning machine can be switched off in a reliable manner by controlled deceleration of the air-cushioned or magnetically mounted traveler.

The process according to the present invention includes four phases and ensures that both during acceleration and deceleration of the spindles no excessively high thread tension peaks are produced and thus thread breakage is avoided or at least the risk of thread breakage is considerably reduced and necking of the thread on the spindles does not occur.

This is ensured in the first and fourth phase by virtue of the fact that in these two phases the speed of the traveler is always greater than the speed of the ring and thus, in these phases similar conditions exist to those which exist when stationary, i.e., non-rotatable rings are used where there is minimal risk of thread breakage and where necking of the thread on the spindle does not occur.

The greater the rotational speed of the traveler, the greater its centrifugal force and thus the greater is the friction on the ring if it rotates on the ring. Thus, with relatively high rotational speeds of the traveler there is a risk of powerful, uncontrolled thread tension peaks being produced which cause thread breakage and may even cause breakage of the traveler. However, in view of the fact that according to the present invention in the second phase the traveler is stationary on the ring, i.e., there is synchronism between the traveler and the ring, there is no sliding friction between the traveler and the ring and thus the thread tension cannot vary considerably, thereby avoiding thread breakage. This also applies to the third phase. In the third phase it is obviously necessary to reduce the rotational speed of the spindle in such a way that an adequate thread tension is constantly maintained. This is achieved by decelerating the ring.

The rotational speed at which the second phase begins, can correspond to the rotational speed at which the fourth phase begins. However, these rotational speeds can also be different. These speeds may also be predetermined. The first phase preferably proceeds as follows: firstly, the rotational speed of the spindle is increased from zero (from the rest state) in a continuous manner until a predetermined rotational speed is obtained. This speed is then maintained at least until synchronous operation between the traveler and the ring is reliably obtained. Immediately thereafter or a specific time thereafter the second phase commences.

The transition from the third to the fourth phase can also take place at a predetermined rotational speed. On reaching this predetermined spindle speed, deceleration of the ring is preferably stepped up. The ring is thus rapidly decelerated and is possibly virtually arrested momentarily. The traveler is then unable to follow this rapid speed reduction of the ring and begins to rotate on the ring.

The process can also be carried out in such a way that the transition from the first to the second phase and/or from the third phase to the fourth phase does not occur at predetermined speeds but more or less at random within a narrower or broader speed range. This is effected, for example, by gradually increasing the spindle speed in a continuous manner during the first and second phase. As a result of the continuous increase in the centrifugal force of the traveler synchronism is obtained between the traveler and the ring within a more or less broad speed range. The same process can be employed when reducing the spindle speed, i.e., the rotational speed of the spindle can be lowered so gradually that the traveler begins to rotate on the ring within a more or less broad speed range owing to the continuous reduction of its centrifugal force.

The following procedural steps can also be provided either individually or combined:

Measurement of the difference between the rotational speeds of the ring and the traveler to determine the synchronous displacement of these parts. Known devices are used for these measurements and the measured values obtained are supplied to a reference instrument which transfers the differential value to a speed control device. The result of this procedure is that firstly the increase in the rotational speed to the operating speed is effected in dependence on an allowable or predetermined thread tension and secondly in that the synchronous displacement of the traveler and the ring is retained for the entire spinning operation owing to the fact that minimum force expenditure with minimum thread tension is thereby obtained.

As has already been stated, it is important that a predetermined thread tension should not be exceeded from the time of commencing synchronous displacement until spinning is terminated. Accordingly, another important procedural step consists in continuously monitoring this tension.

Thread tension peaks which occur for the reasons indicated above can be eliminated or reduced to a tolerable level during spinning or twisting operations using an air-cushioned ring if the unalterable, length variation compensation occasioned by the system and required, for example, for the existing eccentricities is not provided for by additional displacement of the traveler as in the case of non-synchronous spinning or twisting requiring corresponding mass acceleration forces, but by the excess length of the flexible thread balloon. This is only possible if spinning is carried out at the desired high speeds with the least possible tension, i.e., adequate deflection of the thread from the meridian plane and balloon diameter, that is if synchronous spinning is employed.

The balloon form can be used for this purpose in a preferred process in which the thread curve deviation from the meridian plane is measured and the thread tension regulated by variable deceleration of the spinning ring. In other words, the thread tension is increased when the deviation is too great and reduced when it is too small. This is designed to ensure that all times a sufficient thread reserve is available to compensate for the unavoidable length variations which constantly occur between the thread guide and the winding-on point for the most varied reasons--as was described above.

This monitoring and controlling of the balloon form is especially important when the machine is switched off and the air-cushioned or magnetically mounted ring is moving too rapidly owing to its own mass inertia. The risk of necking of the thread is immediately produced under these circumstances owing to the existing minimum thread tension. Thus, when spinning is being terminated it is necessary to decelerate the ring in such a way that the force in the thread portion between the traveler and the winding-on point with the cop, which is required by the traveler in order for it to simultaneously displace the ring during synchronous operation, remains sufficiently great to keep the thread tension in the thread balloon sufficiently high for the system to remain stable and possibly to ensure that the thread is wound-on in a normal manner in the third phase and until returning to the rest state.

The fourth phase begins when the rotational speed of the spindle has been reduced to such an extent that the frictional connection between the traveler and the ring is released owing to the reduced centrifugal force of the traveler. This can advantageously take place in the same manner as during transition from the first to the second phase.

The forces effective in the thread are correspondingly reduced. It is now possible to momentarily decelerate and arrest the ring without any risk to the spinning process. The traveler continues to coast with thread until it comes to a standstill.

Spinning off can be started automatically by means of an end switch when the ring rail bearing the spinning ring and its mounting is in the upper position and thus when the cop is full. The spindle drive motor is preferably only switched off when the rotational speed of the ring has been reduced to the rotational speed of the spindle at the beginning of the fourth phase.

As the difference in friction between the air-cushioned rings of a particular machine and also between machines of the same design are insignificant, the measuring and control operation need only be carried out at one spindle. For safety reasons on account of thread breakage, it may be advisable to carry out these operations at a number of spindles parallel thereto and, as a result, virtually identical thread tension cycles can be obtained at all the spinning or twisting stations of a particular machine. It is even possible to operate a series of identical machines using the same raw material and yarn number in synchronism with a single measuring and regulating unit.

The spindles of a spinning or twisting machine can be driven in common or individually by means of associated synchronous motors. In the latter case, the synchronous motors can be jointly supplied with power.

The spindles on at least one side of the spinning or twisting machine, and preferably all the spindles of such a machine are driven in synchronism with one another, for example by bands driven by a drum or a tangential belt or by synchronous motors. Thus, the process according to the present invention is normally carried out in such a way that all the spindles are always driven in synchronism with one another. Accordingly, it is only necessary to provide one of the sensing, control and regulating devices represented in FIGS. 2 and 3, i.e., it is only necessary to provide these devices for one spinning or twisting station of the machine. This one spinning or twisting station then constitutes the guide spinning or twisting station for all the other spinning or twisting stations, the spindles of which operate in synchronism with the "guide spindle." It is also possible to decelerate the rings in synchronism by varying the braking force acting on the rings in a uniform manner, that is if the braking force is variable.

According to the present invention elements of apparatus having the following features can be provided to implement the process of the invention.

Measuring devices for measuring the difference in the rotational speed between the traveler and the ring and for measuring the thread tension and the thread curve. A speed control device designed to be influenced by the measuring devices. An end switch for starting the switching-off process and a means for preselecting the cut-off speed at the speed control device. A blocking brake for the spinning ring.

BRIEF DESCRIPTION OF THE DRAWINGS

FIGS. 4 and 5 are enlarged and expanded diagrams showing further details of the device of FIG. 3.

DESCRIPTION OF THE PREFERRED EMBODIMENT

Figure 1:
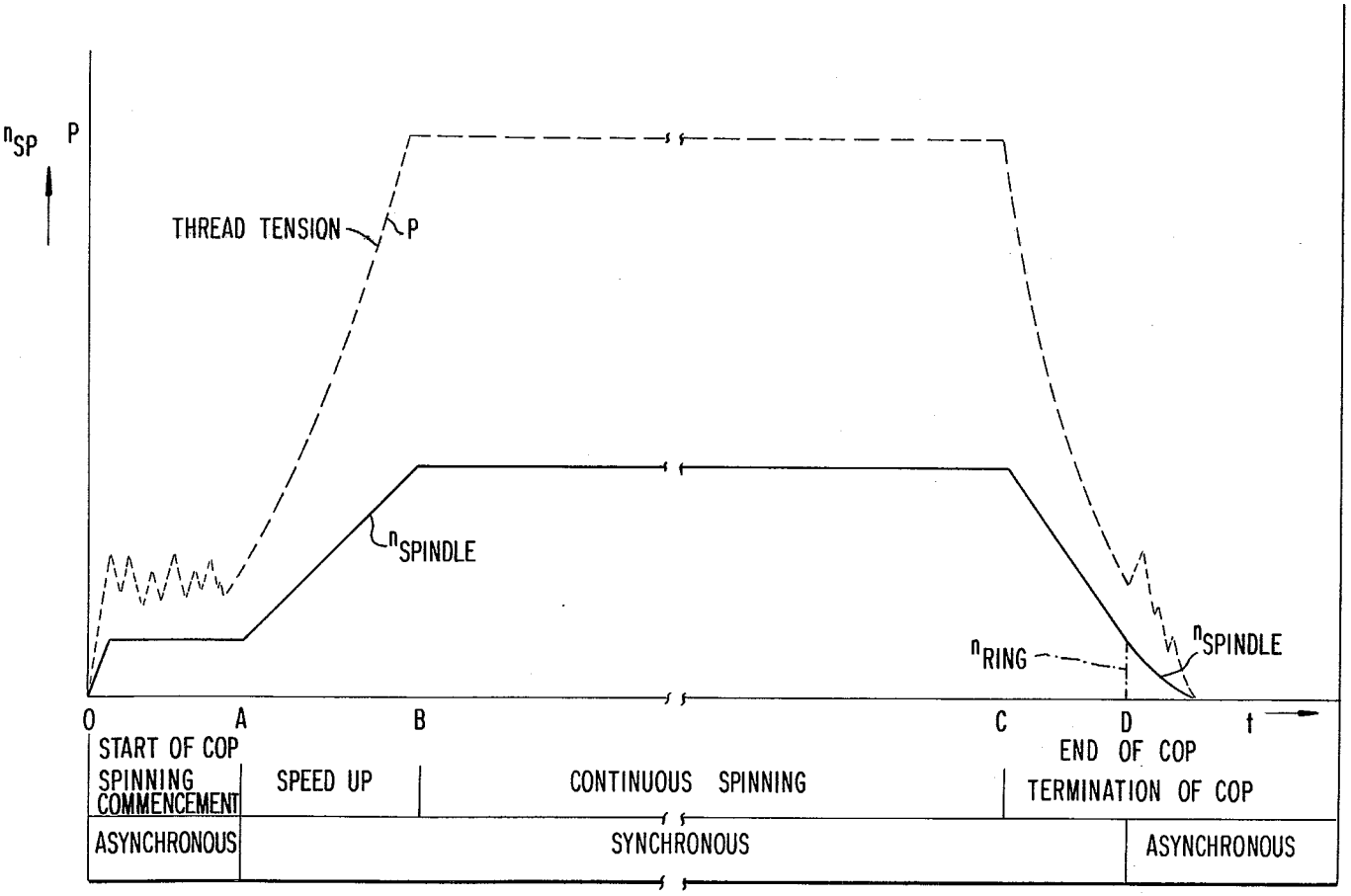
FIG. 1 is a diagram which depicts the various steps or phases of the entire spinning process. The abscissa represents time and the ordinate represents spindle speed or thread tension.

In the diagram shown in FIG. 1, 0 represents the switch-on point of the regulatable spindle drive motor which initially brings the spindle to a moderate speed of 7,000 rpm, for example. At this rotational speed, according to the invention, the thread tensions and their peaks are within limits which present no difficulty.

The irregular course of the thread tension to the point A is represented by the dashed lines in the diagram.

When commencing spinning, the twisting or spinning ring 4 (FIG. 2) is accelerated by a rotating traveler 10 which is guided on the ring 4 by friction produced by centrifugal force. The acceleration continues until both the ring 4 and the traveler 10 become engaged in a force-locking manner, also by virtue of centrifugal force, and rotate at the same speed. In this condition the ring 4 and traveler 10 cease to be displaced relative to one another. At this point which is represented by point A in the diagram, so-called synchronous operation commences and the thread tension peak caused by friction is reduced. The above will be designated the first phase while the point A will be designated hereinafter as the starting speed of the second phase.

Even with the increase in rotational speed which begins with the second phase, the marked tension peaks do not occur as long as synchronous operation is continued. The thread tension increases in a uniform manner to point B shown in the diagram. This is achieved by virtue of the marked balloon height H (FIG. 2) when commencing spinning and the minimal thread tension in the balloon thread which is made possible by maintaining synchronous operation.

The rotational speed of the spindle 1 is now only limited by the basic tension produced in the thread. However, this is considerably lower, especially at high rotational speeds of the spindle 1, than the tension peaks produced at corresponding speeds when spinning is carried out in a conventional manner and not synchronously using an air-cushioned mounting.

When the rotational speed rises from A to B it is possible, as has already been stated, for the friction to become so small that as a result the balloon diameter increases in an undue manner and necking and thread breakage may possibly occur. This would certainly commence from point C in the diagram during switching-off if counter measures were not implemented. It is necessary both when commencing and terminating spinning for the air-cushioned or magnetically mounted ring 4 to be decelerated to such an extent that the force in the thread portion between the traveler 10 and the winding-on point with the cop which is necessary to rotate the same is so great that the thread tension in the balloon is equally great such that the system remains stable and normal thread winding is ensured until the end of that particular operation.

If, during the course of swithing-off the rotational speed drops down to the starting speed of the second phase (point D of the diagram) the force-locking connection or coupling between the traveler 10 and the ring 4 is again broken owing to the reduction in the centrifugal force of the traveler 10. The forces effective in the thread also decrease correspondingly. There is now no risk to the spinning process if the spinning ring 4 is momentarily braked whereupon the traveler with the thread coasts in a normal manner until it comes to a standstill.

Figures 2, 3:
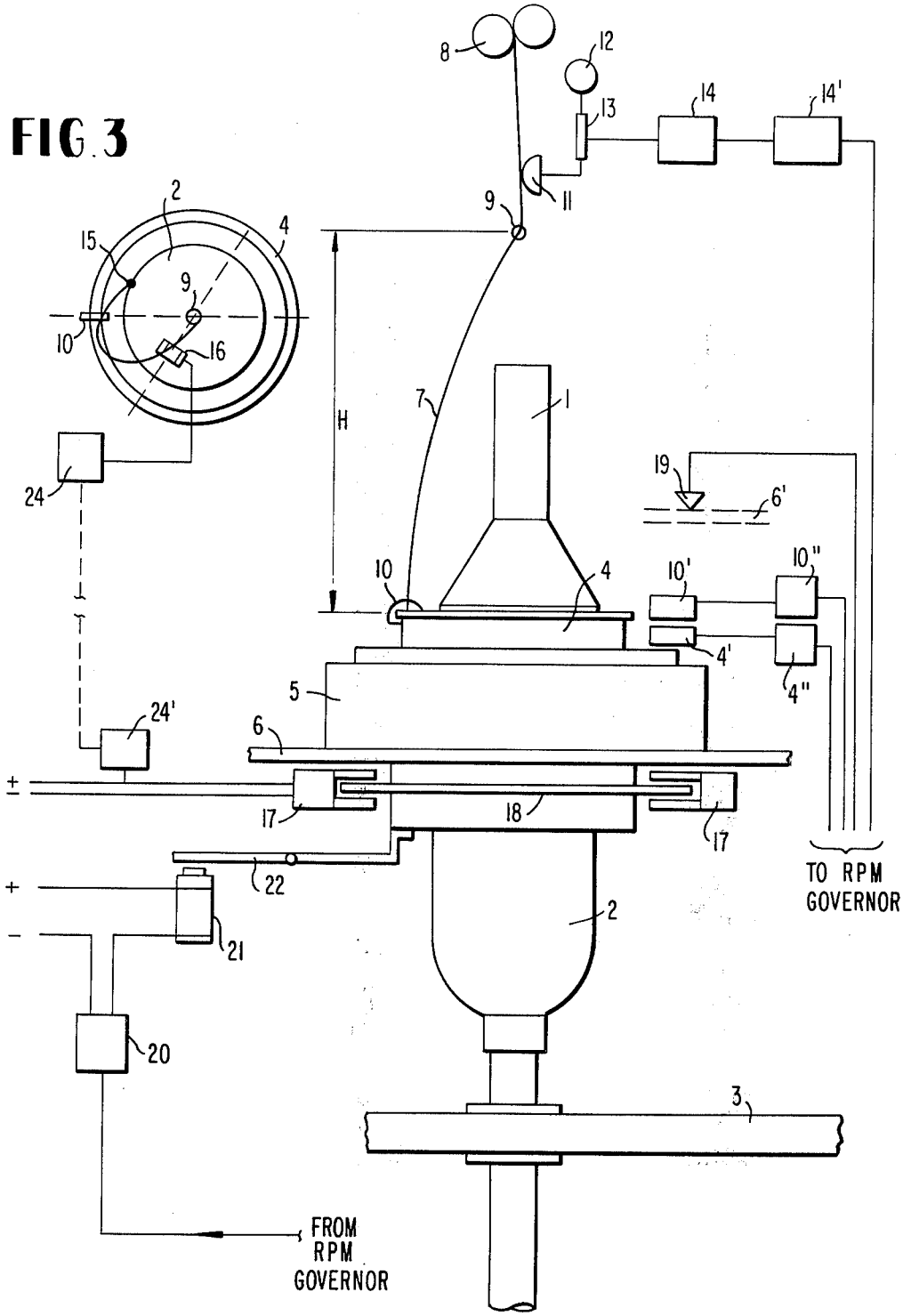
FIG. 2 illustrates in schematic form apparatus according to a preferred embodiment of the present invention including a spindle and drive means, thread guidance means, a measuring device for the thread tension, a traveler and spinning ring, a speed control device and circuit connections. These are shown at a single spinning or twisting station of the machine.
FIG. 3 is a top view of the course of the thread, illustrating a measuring device for the thread curve outside of the meridian plane and circuit connections.

In FIG. 2, the spindle 1 bears a sleeve on which the cop 2 is formed. The spindle 1 is driven in a manner known per se by a regulatable motor via a belt 3. The spindle 1 and the cop 2 are surrounded by the spinning ring 4 which is mounted in an air-cushioned manner in a sleeve 5. The sleeve 5 is carried by a ring rail 6.

The spinning thread 7 is discharged from a drawing system 8 and is guided by a thread guide 9 to the traveler 10. From the traveler 10 the thread 7 passes to the spindle 1 and to the sleeve on the spindle 1 where it forms the cop 2.

The traveler 10 is guided on the upper edge of the spinning ring 5 which it carries with it, dragging it by the thread 7. It does so by overcoming the air friction by virtue of the friction by centrifugal force. In the course thereof the spinning ring 5 is continuously accelerated until the friction or rotational speed is sufficiently high for the relative displacement of the traveler 10 and the ring 4 to become zero and for synchronous operation of the traveler 10 and the ring 4 to commence. Sensing elements 10′, 4′ are used to monitor the rotational speed of the traveler 10 and the ring 4. These sensing elements 10′, 4′ send a signal to a speed control device and cause it to regulate the rotational speed via amplifiers 10″, 4″, as soon as synchronous operation commences between the traveler 10 and the ring 4.

The thread tension is monitored by a pick-up 11 which is mounted about a shaft 12 and is periodically pressed against the thread portion between the drawing system 8 and the thread guide 9. By only pressing the pick-up 11 periodically against the thread it is possible to avoid disturbing the continued twist of the thread as far as the pair of discharge rollers of the drawing system. A strain measuring strip 13 is disposed between the pick-up 11 and the shaft 12. The strain measuring strip 13 transmits signals proportionate to the thread tension via a sensing element and further electric or electronic device 14, 14′ to a speed control device (not shown). This speed control device prevents the rotational speed of the spindle 1 from increasing once a predetermined maximum thread tension has been reached even if the operating speed has not been attained. The transmission processes from the pick-up to the control device do not form part of the present invention and as they are known per se they will not be described in further detail.

The thread deviation from the meridian plane defined by the traveler 10 and the axis of the spindle 1 is used as a further, indirect means of monitoring the thread tension.

According to FIG. 3, the thread, viewed from above, forms a curve which starts from the thread guide 9 and passes through the traveler 10 to the winding-on point 15 onto the cop 2. A sensing element 16 consisting of a series of very small photocells is overlapped by the thread forming the balloon over a specific angular region viewed on the spindle axis. Periodic flashes are directed at the balloon thread by a trigger device controlled by the traveler 10. The trigger device includes, for example, a stroboscope. As a result, a signal is transmitted by the latter via the photo cells of the sensing element 16. This signal corresponds to the angle which the tangent on the arc of the thread which passes through the middle point of the thread guide forms with the connecting line between the traveler 10 and the spindle axis 1. The larger the angle, the "softer" the balloon. Thus, the risk of necking increases for the thread 7. The ring 4 must thus be decelerated until the thread tension required for a stable thread balloon is maintained. A magnetic brake 17 is used for this purpose. The magnetic brake 17 engages with its pole shoes over a friction disc 18 which, in turn, is rigidly connected to the ring 4. This eddy current brake is controlled by the signals which the sensing element 16 transmits via an amplifier 24 and a control device 24'. As in the case of the speed control device, the features of the transmission processes from the sensing element 16 are not part of the present invention and will not be described in further detail.

Instead of decelerating, it is possible to raise the speed increase per unit of time during the speed increasing phase until the operating speed is attained, such that increased force and thus increased thread tension is required to accelerate the spinning ring 4.

As a variant of the described arrangement of the sensing element 16, it is possible to locate this element 16 behind the balloon line of the thread (FIG. 2). In this way, the balloon form is used directly to regulate the thread tension. However, in view of the influence of the balloon constricting ring which is generally provided, the arrangement shown in FIG. 3 would seem more expedient.

In place of the magnetic brake 17, it is also possible to use an air brake controlled by the sensing element 16.

To stop spinning, the ring rail 6 actuates in its uppermost position 6' an end switch 19 which begins the switching-off process (FIG. 1, point C). In the course thereof the speed control device is caused to reduce the rotational speed. The ring 4 is simultaneously decelerated by a proportionate amount. This is necessary to maintain the necessary thread tension and to keep the balloon stable. Without this decelerating action the spinning ring would maintain its existing high rotational speed under the influence of its weight, and its stability by virtue of its air-cushioning and would cause thread breakage. The magnetic brake 17 is again used for proportionate deceleration.

When the spinning speed has been reduced to the starting speed while maintaining synchronous operation (FIG. 1, point A or D), the motor is switched off via the speed control device. The force-locking connection between the traveler 10 and the spinning ring 4 is broken as a result of the reduction in the centrifugal force and the machine continues to slow down normally with the aid of the traveler 10 when the ring 4 is arrested at the same time as the motor is switched off. For this purpose the speed control device engages a magnet 21 via a magnetic switch 20. The magnet 21 presses a braking lever 22 against the lower edge of the spinning ring 4 and brings the ring to a standstill. In FIGS. 4 and 5 the arrangement of FIG. 3 is explained in more and further details. In stationary relationship to the ring 4 is a sensing element 25 which feels the passage of the traveller 10. The sensing element is a detector producing a magnetic field and each passage of the traveller changes the magnetic field and this will be caused to produce an electrical impulse formed by a pulse former stage 26 and triggers a trigger means 27 of a stroboscope 27, 28 for producing flashes of the stroboscope lamp 28 illuminating the thread 7 of the thread ballon. The flashes are in this way produced each time as the traveller arrives at a predetermined position on th ring. If the thread tension is high the loop of the flashed thread to be seen in FIG. 5 is narrower than if the thread tension is lower. Outside the thread ballon is a series of very small photo cells 16' arranged in one row and forming a sensing element 16. If the thread tension is normai the thread during the flash is opposite to the central photo cell 16'. If the thread tension is high the thread is opposite to one of the both left photo cells 16'.

If the thread tension is too low the thread is opposite to one of the right photo cells 16' in FIG. 5. Each flash illuminates the thread e.g. between the points A and B and the photo cell opposite this thread will therefore produce an electrical impulse and the amplifier 24 has five separate amplifiers, one for each photo cell and if one amplifier connected to the both left photo cells has an output signal the power or force of the magnetic brake 17 will be diminished and if one of the both left photo cells 16' will produce a signal to its amplifier then the power or force of the magnetic brake 17 will be increased thereby. If the central photo cell 16' feels the flashed thread then the thread tension is correct and the power or force of the magnetic brake is not changed.

The trigger means 27 could have adjustable time delay means to change the position of the traveller at which the flash will be produced for adjusting this position in a desired manner. In the described way the thread tension will be maintained at a predetermined value range or desired value.

What is claimed is:

1. A process for controlling the rotational speed of a spinning or twisting ring of a spinning or twisting machine during a spinning or twisting operation, the machine including: a spinning or twisting ring; a traveler mounted on the ring; a rotatably drivable spindle passing through the ring, the spindle being rotatably driven from a rest state to an operating speed thus corresponding to a first and second phase of operation and from the operating speed back to the rest state thus corresponding to a third and fourth phase of operation; and a sleeve disposed on the spindle, the traveler being adapted during spindle rotation to draw the thread producing a tension therein and cause it to be wound on the sleeve and in the process of drawing the thread the traveler drives the ring, the process including the steps of:

a. increasing the rotational speed of the spindle up to its operating speed such that the traveler rotates relative to the ring during the first phase of operation thereby causing the ring to accelerate, and the traveler rotates in synchronism with the ring during the second phase of operation with both the traveler and ring being accelerated;

b. reducing th rotational speed of the spindle from its operating speed during the third phase of operation such that the traveler and ring continue to rotate in synchronism with the ring deceleration being such that the tension in the thread is retained at an adequate level to prevent rupture thereof; and c. reducing the rotational speed of the spindle to zero during the fourth phase of operation such that the traveler rotates relative to the ring with the ring decelerating faster than the traveler and with the ring being brought to rest prior to the traveler.

2. The process as defined in claim 1, wherein during the first phase of operation the spindle speed is initially increased in a continuous manner and is then kept constant at least until such time as the ring speed reaches the traveler speed and until the end of the first phase.

3. The process as defined in claim 1, wherein the rotational speed of the spindle is increased in a continuous manner during the entire second phase of operation.

4. The process as defined in claim 1, wherein the spindle speed is reduced in a continuous manner in the third phase of operation.

5. The process as defined in claim 1, wherein the spindle speed is reduced more slowly over at least part of the fourth phase of operation than in the third phase of operation.

6. The process as defined in claim 1, wherein the ring is at least temporarily braked in at least the first phase of operation.

7. The process as defined in claim 6, wherein the motor driving the spindle is switched off at the beginning of the fourth phase of operation and the ring is arrested almost instantaneously by the application of a powerful braking force.

8. The process as defined in claim 1, wherein the ring is at least temporarily braked in at least the second phase of operation.

9. The process as defined in claim 8, wherein the motor driving the spindle is switched off at the beginning of the fourth phase of operation and the ring is arrested almost instantaneously by the application of a powerful braking force.

10. The process as defined in claim 1, wherein the ring is continuously braked.

11. The process as defined in claim 1, wherein the second and fourth phases commence at speeds which are less than half the operating speed of the spindle.

12. The process as defined in claim 1, wherein during acceleration of the ring from the rest state no braking of the ring occurs at least in the second phase of operation.

13. The process of claim 1, further including the step of air-cushioning the ring.

14. The process as defined in claim 1, further including the step of aerodynamically air-cushioning the ring.

15. The process as defined in claim 1, further including the step of mounting the ring magnetically.

16. The process as defined in claim 1, further including the step of measuring the speeds of the traveler and the ring in the second and third phase of operation, and reducing any speed differences to zero by influencing the speed of the spindle.

17. The process as defined in claim 16, further including the step of maintaining the speed of the spindle constant while reducing the speed difference to zero.

18. The process as defined in claim 1, further including the step of measuring the speeds of the traveler and ring in the second phase of operation, and reducing any speed differences to zero by influencing the speed of the spindle.

19. The process as defined in claim 18, further including the step of maintaining the speed of the spindle constant while reducing the speed differences to zero.

20. The process as defined in claim 1, further including the step of measuring the speeds of the traveler and ring in the third phase of operation, and reducing any speed differences to zero by influencing the speed of the spindle.

21. The process as defined in claim 20, further including the step of maintaining the speed of the spindle constant while reducing the speed differences to zero.

22. The process as defined in claim 1, further including the step of measuring the tension of the thread running to the traveler at least during the second phase of operation, and keeping the spindle speed constant if the measured tension exceeds a specific predetermined value until the thread tension has returned to the predetermined value.

23. The process as defined in claim 1, further comprising the steps of: illuminating a portion of the thread at least in the second and third phases of operation by stroboscopic light flashes which emanate from a predetermined location, the flashes being controlled by the traveler; sensing the position of the illuminated portion of the thread by at least one photosensitive detector; and returning that portion of the illuminated thread to the other side of the predetermined location when the predetermined location is traversed.

24. The process as defined in claim 23, wherein the returning step takes place by suitable deceleration of the ring.

25. The process as defined in claim 1, wherein the ring is decelerated by means of an eddy current.

26. The process as defined in claim 1, wherein the traveler remains immobile on the ring during the entire period between the second and third phases of operation.

27. The process as defined in claim 26, further comprising the step of regulating, preferably by variable deceleration of the ring, the tension of the thread running to the traveler.

* * * * *